US009041309B1

(12) United States Patent
Shane

(10) Patent No.: US 9,041,309 B1
(45) Date of Patent: May 26, 2015

(54) DYNAMICALLY PROGRAMMABLE LED ILLUMINATION SYSTEM, METHOD AND APPARATUS

(71) Applicant: Scott M. Shane, Woodland Hills, CA (US)

(72) Inventor: Scott M. Shane, Woodland Hills, CA (US)

( * ) Notice: Subject to any disclaimer, the term of this patent is extended or adjusted under 35 U.S.C. 154(b) by 0 days.

(21) Appl. No.: 14/047,800

(22) Filed: Oct. 7, 2013

Related U.S. Application Data

(60) Provisional application No. 61/711,694, filed on Oct. 9, 2012.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.
CPC ..... *H05B 33/0842* (2013.01)

(58) Field of Classification Search
None
See application file for complete search history.

(56) References Cited

U.S. PATENT DOCUMENTS

| | | | | |
|---|---|---|---|---|
| 8,766,880 | B2 * | 7/2014 | Kharrati et al. | 345/46 |
| 2013/0127369 | A1 * | 5/2013 | Campbell et al. | 315/292 |

* cited by examiner

*Primary Examiner* — Anh Tran

(57) ABSTRACT

A dynamically programmable LED illumination system, method and apparatus provides for a dynamically programming an LED illumination unit including LED bulbs affixed on a circuit board and arranged to providing an animating display (such as a logo, sign, . . . ), where a user can customize the animating display on the LED illumination unit by selecting control signals. LED bulbs in the unit can illuminate or be adjusted such as to provide an animating display to a viewer.

6 Claims, 8 Drawing Sheets

BASE & BODY

FIG 9
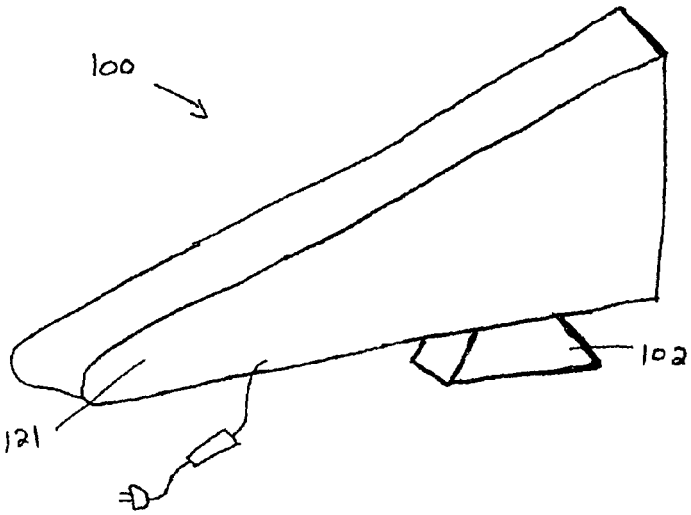
BODY & BASE (Rear View)
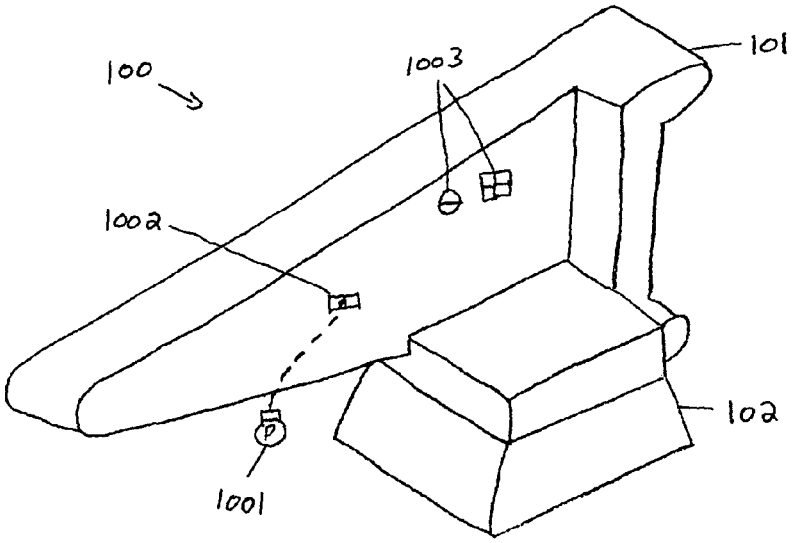
FIG 10

DYNAMICALLY PROGRAMMABLE LED ILLUMINATION SYSTEM, METHOD AND APPARATUS

CROSS-REFERENCE TO RELATED PATENT APPLICATION

This application claims the benefit under 35 U.S.C. §119 (e) of U.S. Provisional Patent Application. No. 61711694, filed on Oct. 9, 2012 in the U.S. Patent and Trademark Office, the entire disclosure of which is hereby incorporated by reference.

FIELD OF THE INVENTION

The present application relates to a dynamically programmable light emitting diode ("LED") illumination system, method and apparatus. Particularly, the present invention provides a dynamically programmable LED illumination display system that controls the display properties of one or more LED bulbs, where the display is programmable.

BACKGROUND OF THE INVENTION

U.S. Pat. No. Des 371,154, incorporated by reference in its entirety, discloses a sports pennant shaped light display unit comprising of neon lights of various colors. Conventionally, neon illumination only allowed for a limited range of colors and limited design functions. The spectrum of neon lights is limited to 26 colors. The cost of manufacturing neon illuminated units is expensive and a major obstacle for shipping and distribution. Neon lighting has become outdated and obsolete. LED lighting provided an improved system for providing light displays. The LEDs can be programmed individually or in groups comprising a plurality of LEDs. LED lighting provides for higher visibility, versatility, recognition, wider range of color, and brightness or dimness of illumination than traditional lighting. The spectrum of LED lighting includes over 30,000 different colors. The cost of LED lighting technology is significantly less than conventional lighting, and the lifespan is considerably longer.

Traditionally, the small size of LEDs have provided for development of LED based display systems. A two dimensional array of individually controlled LEDs can be used to display words and images. LEDs can provide the light source for many display systems.

There are many types of LED signs in the conventional art. One type of LED sign is a fixed word sign made from a circuit board with LED's arranged in the circuit board (ie., to form letters to make a word) in a road sign. For example, LED signs are made for street addresses on houses or businesses, menu displays, personalized license plates, information (OPEN, CLOSED, EXIT, etc). These signs are made of a mechanical alphanumeric character arranged and attached to a substrate to hold them in place.

Further, traditional LED signs incorporate individual circuit boards with alphanumeric characters formed by LEDs placed in appropriate pattern on each individual circuit board to form the character. LEDs used in characters can be different colors and patters. U.S. Patent Publication No. 2003/0167666 discloses a fixed character, LED alpha-numeric message display system consisting of individual circuit boards where each circuit card has LEDs placed on the surface with their light source in an arrangement of an alphanumeric character. The LED's are arranged in a pattern, which represents numerals, letters, characters, or other symbols. The circuit boards are electromechanically connected to one another where each circuit card buses power and ground from one circuit board to the next. The character boards are arranged in an order to form words and numbers by placing the character circuit boards abut to one another. These traditional LED signs are inflexible as they do not provide programmable, scrolling or customized displays, among other discrepancies.

Further, traditional LED characters are incorporated into a circuit board encased in clear plastic extrusion or co-extrusion with caps to seal the ends. The enclosure mechanically support and retain the character circuit boards. The enclosures are functional only to encase the circuit board (like a cover), but are not operationally lexible and not customizable to coordinate with the LEDs.

Embodiments of the present invention address at least the drawbacks associated with conventional LED lighting and display system, therein.

SUMMARY OF THE INVENTION

As noted above, exemplary embodiments of the present invention address at least the above problems and/or disadvantages, and provide at least the advantages described below.

An exemplary embodiment of the present invention provides a user programmable LED illumination system, method and system that is customizable such that the visual display of the LED illumination unit is animating and customize-able according to the desire of a user/viewer. The visual display comprises an arrangement/combination of LED lights/bulbs and faceplate on the unit such as to provide a three dimensional visual display to the user. A plurality of LED bulbs can be arranged on a printed circuit board to form various shapes (e.g., letters, numbers, objects, etc.), where each LED lights/bulbs can be programmed and/or controlled to provide an animating display. As an improvement over conventional technology, exemplary embodiments of the present invention provide for LED illuminated display that allows for more choices for customizing and better viewer experience. For example, the LED illumination unit according to exemplary embodiments of the present invention provides for sequencing LEDs, chasing LEDs, flashing LEDs, animation, and multiple color changes, all within a single LED bulb and/or a group of one or more LED bulbs.

According to exemplary embodiments of the present invention, the LED illumination unit comprises one or more printed circuit boards (each having one or more LEDs) comprising at least one microcontroller ("POD") connected to a master controller. The master controller provides (dispatches) control signals to each POD for displaying. Each POD controls a group of at least one LED for providing a programmed display and receives/transmits control commands from/to the master controller. The master controller sends/receives control commands to/from each POD for controlling the display of the group of at least one LED. For example, the master controller can send commands to a first POD to control a group of flashing LEDs, while sending commands to a second POD to control a group of constantly lit LEDs.

Another exemplary embodiment of the present invention provides for changing, programming and/or customizing the display of the LED illumination system from a location remote to the LED illumination unit. A remote controller provides a control signal to the LED illumination unit in the LED illumination system for controlling the display of the unit. The remote control signal comprises a signal to control the display to dim, flash, chase a sequence of lights. An exemplary embodiment of the present invention also provides for a user to be able to change the display of the LED illumination system from control input means on the LED illumination unit (such as buttons, knobs, etc. . . . located on the body of the unit).

An exemplary embodiment of the present invention provides for a master control unit attached to or comprised in the LED illumination unit of the programmable LED illumination system and apparatus. The master control unit is connected to the PODS via a wire or wireless connections. The master control unit receives a received control signal from the remote controller or other source (such as a personal computer, smartphone, user input, etc. . . . ), and generates a LED control signal transmitted to at least one POD for controlling the LEDs coupled to each POD. The LED control signals to each POD may be individual and independent of LED control signals to other PODS, or some may be the same. For example, the master control unit generates and transmits a first LED control signal to a first POD to have a chasing sequence of border lights, a second LED control signal to a second POD to flash a basketball looking object, and a third LED control signal to a third POD to have a constantly bight display of a sports team's name, and a fourth LED control signal to a fourth POD to have a dimming/brightening effect of another display object/letter/word, etc.

Another exemplary embodiment of the present invention provides for the LED illumination unit having a graphical display including at least one changeable faceplate displaying graphical logos or objects. The faceplates can be backlit, front-lit, or any combination of the components, as mentioned above.

Another exemplary embodiment of the present invention provides for the LED illumination unit comprising LED lighting which provides for unique enhanced ornamental design. For example, LED lights allows for mixing and matching various components and adopting those components to the graphical needs of any end user (such as for a team or corporate logo). For example, the LED illumination unit can be incorporated for use with sports merchandise image (such as the Los Angeles Dodgers).

Other exemplary embodiments of the present invention provides for the following sizes/configurations/implementations of the LED illumination systems, methods and/or apparatuses: (1) Self standing Table or Bar Display Unit; (2) Wall Mounted Style Unit; (3) Hanging Style Unit; (4) Vertical Style Unit; (5) Smaller Nightlight Unit (comprising Motion Sensors to Embody On/Off Functions, Includes another motion sensor which triggers a clock display, ABS Fire Retardant Molds/Body, LED Illuminated and Dimmable Graphic Display); (6) Six foot Unit/Computer Controlled (comprising Audio Output, Changeable Graphic Logos, Additional Code Changes through the Manual Transmitter/Controller); (7) Jumbo Version Unit—Large Scale (e.g., "Jumbotron", Spinning, and Fully LED Animated Graphic Display, a working Sports/Entertainment Television. Various sizes: Twenty five feet tall, and Forty-five feet long. Also includes an ability to launch fireworks and Emit Lasers from the top of the sign).

The LED illumination system, method and apparatus, according to exemplary embodiments of the present invention, provides for a wonderful combination of art and technology that overcomes the deficiencies of the conventional and traditional arts.

BRIEF DESCRIPTION OF THE DRAWINGS

The above and other exemplary features, aspects and advantages of the present invention will become more apparent from the following detailed description of certain exemplary embodiments thereof when taken in conjunction with the accompanying drawings in which:

FIG. 9 is a rear perspective view of the LED illumination unit, according to an exemplary embodiment of the present invention.

FIG. 10 is a rear perspective view of the LED illumination unit with attachable devices, according to an exemplary embodiment of the present invention.

Throughout the drawings, like reference numerals will be understood to refer to like elements, features and structures.

DETAILED DESCRIPTION OF EXEMPLARY EMBODIMENTS

The matters exemplified in this description are provided to assist in a comprehensive understanding of exemplary embodiments of the present invention described with reference to the accompanying drawing figures. Accordingly, those of ordinary skill in the art will recognize that various changes and modifications of the exemplary embodiments described herein can be made without departing from the scope and spirit of the present invention. Also, descriptions of well-known functions and constructions are omitted for clarity and conciseness. Likewise, certain naming conventions, labels and terms as used in the context of the present disclosure are, as would be understood by skilled artisans, non-limiting and provided only for illustrative purposes to facilitate understanding of certain exemplary implementations of the embodiments of the present invention.

Exemplary embodiments of the present invention provide a user programmable LED illumination system, method and system that is customizable. The visual display of the LED illumination unit is animated and customize-able by utilizing a programmable circuitry in the LED illuminating unit according to a selection made by a user providing programming instructions via an input device (such as a remote controller or input buttons located on the LED illumination unit).

Figure 1:
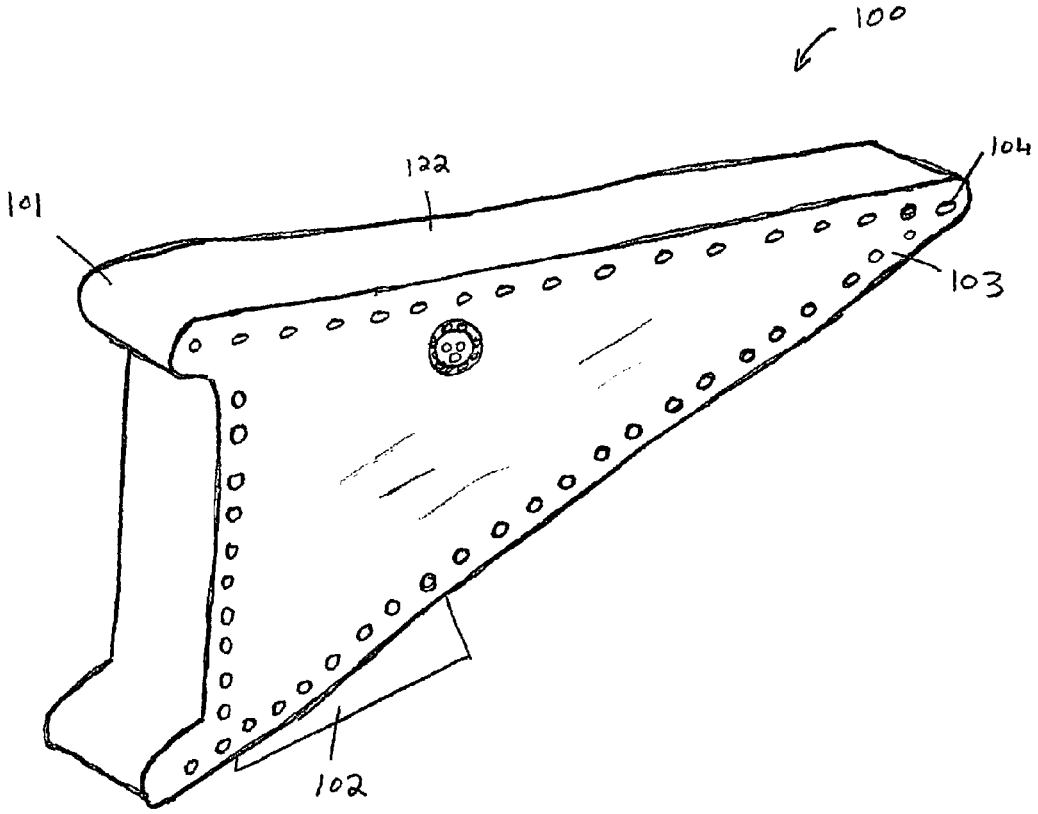
FIG. 1 is a perspective view of the LED illumination unit, according to an exemplary embodiment of the present invention.

FIG. 1 illustrates a perspective view of the LED illumination unit 100, according to an exemplary embodiment of the present invention. The LED illumination unit 100 provides for a three-dimensional visual display for a user (for example, an LED illuminated sign in the shape of a sports pennant, roadsign, building sign, banner, etc.

According to an exemplary embodiment of the present invention, as shown in FIGS. 1, 7, 9, and 10. The LED illumination unit 100 comprises an outside component that is visible to the user, and an inside component that is not visible to the user because it is fully encased inside the LED illumination unit 100. According to an embodiment, the outside component of the LED illumination unit comprises two molded pieces (1) a body 101 including a faceplate 103 and (2) a base 102. The body 101 and base 102 can be vacuum formed, injection molded, and/or assembled together by any means to create the LED illumination unit 100. Both pieces, the body 101 and the base 102 are made of ABS fire retardant material, or any other material that is approved by the Underwriters Laboratory ("UL"). The body and the base are fused together using a fast drying and extremely strong epoxy and/or glue. The base can be in various shapes depending on the exemplary embodiment. For example, the base can be rectangular or custom shaped to support the embodiment of the body piece, the base can also house and hide some or all of the electric components (e.g., the transformer(s), controller, circuit board, RF receiver/transmitter, power supply, etc) so that the outside appears smooth and neat to the user, and secures the electric components, as shown in FIG. 1.

Figure 7:
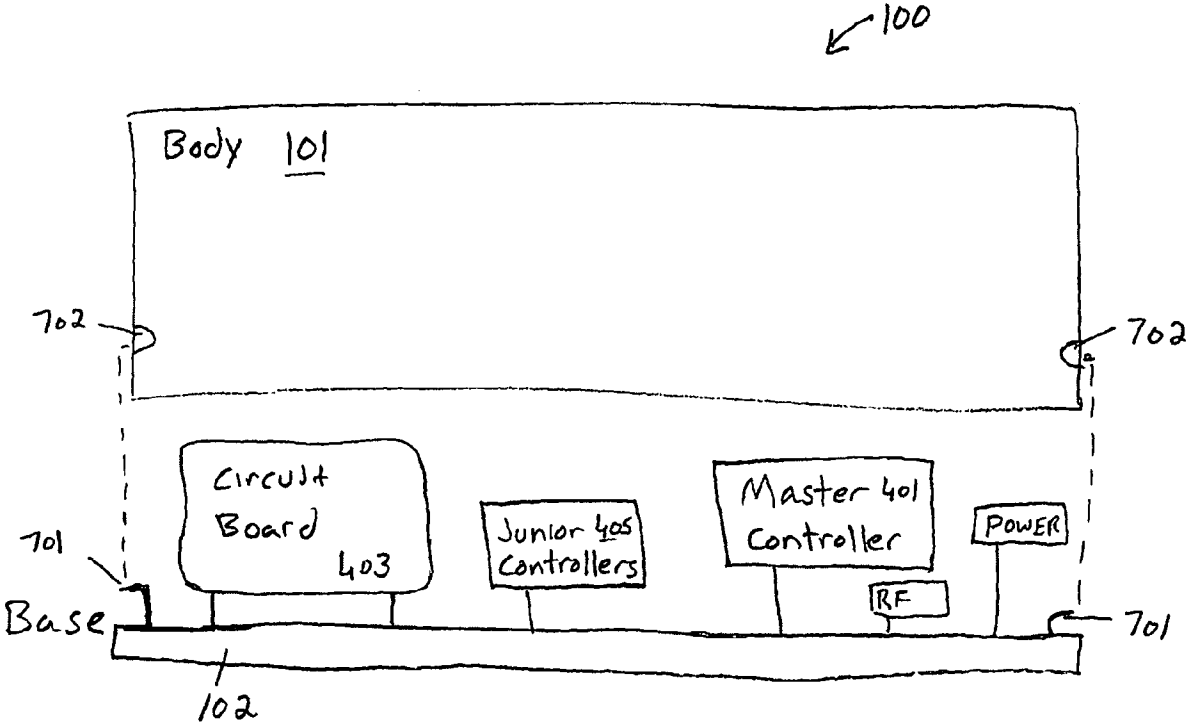
FIG. 7 is a block diagram of the LED illumination unit illustrating the structural relationship between the base unit and body unit with internal components of the LED illumination unit, according to an exemplary embodiment of the present invention.

According to an exemplary embodiment of the present invention, as shown in FIGS. 1 and 7, the body 101 can be secured to the base 102 by using metal and/or nylon screws, widgets, hooks, clasps, sockets, fastners, and/or any other means 701, 702 to secure the body 101 onto the base 102. Alternatively, the body can be secured to the base by using a clasping means 701, 702 that secures the body onto the base once the based is push in place on the base. For example, the body can be secured in place by having the body slip over the base and clasps on the body align with respective grooves 701, 702 in the base to secure the body onto the base.

According to an exemplary embodiment of the present invention, the body 101 comprises a faceplate 103 (described below) to allow light emitted from the LED bulbs 104 to be visible to the user, either by backlit LED bulbs with an acetate translucent faceplate to allow light to be emitted from the LED illumination unit, or front-lit LED bulbs (that protrude through the faceplate) with partial or fully non-transparent faceplate to allow direct light to be emitted from the LED illumination unit.

According to an exemplary embodiment of the present invention, the body may be one single piece or comprise a plurality of pieces that are assembled together by the means described above. For example, the body may comprise a top piece 122, back piece 121 and a faceplate 103 that are assembled together to form the body 101 that takes shape around the base 102.

Visual Display

Figure 2:
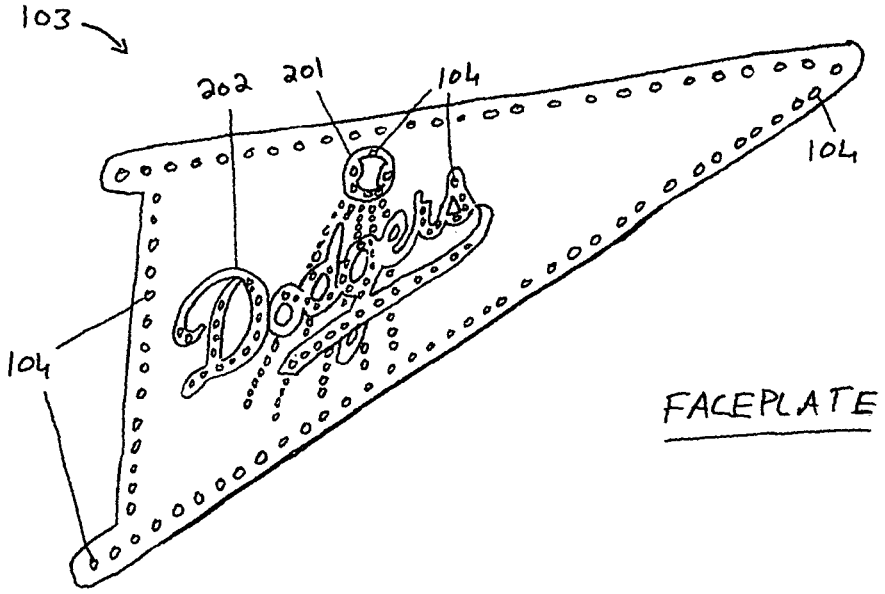
FIG. 2 is a perspective view of the faceplate of the LED illumination unit, according to an exemplary embodiment of the present invention.
Figure 3:
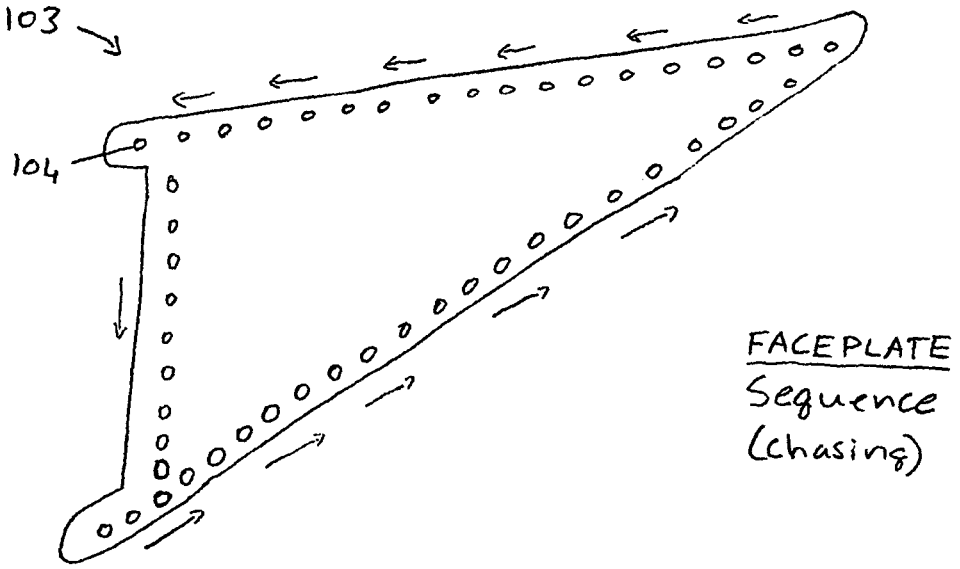
FIG. 3 is a perspective view of the faceplate of the LED illumination unit with LED bulbs illuminated along the boarder and operating according to a custom program, according to an exemplary embodiment of the present invention.
Figure 4:
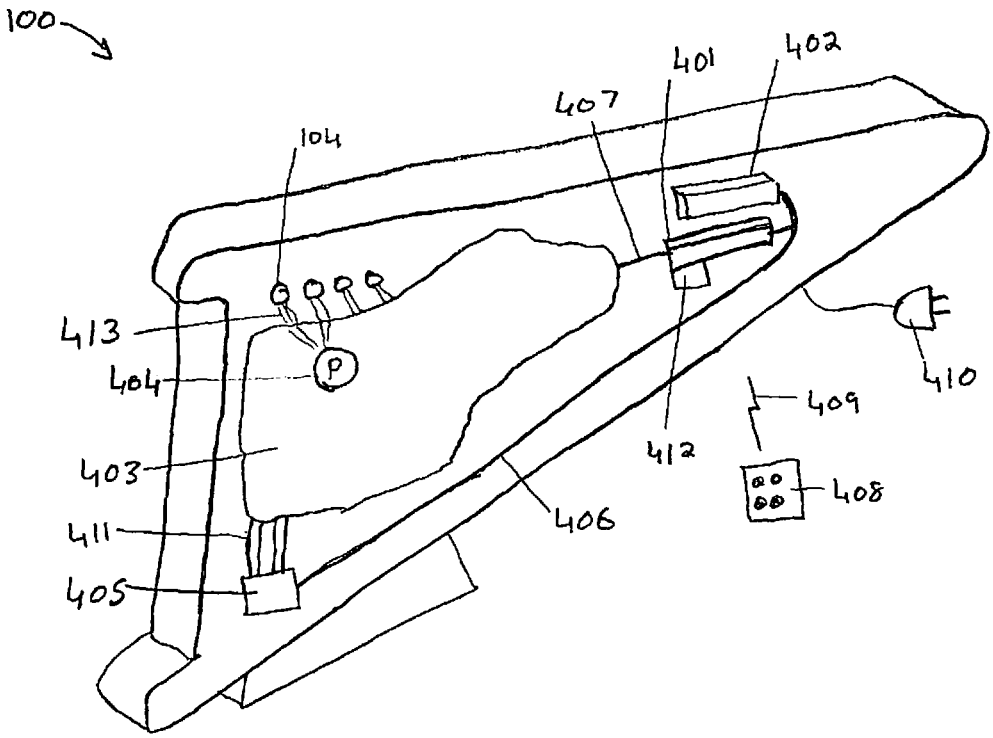
FIG. 4 is a perspective view of the LED illumination unit with a sectional view to illustrate components comprised in the LED illumination unit (view without the faceplate), according to an exemplary embodiment of the present invention.

According to an exemplary embodiment of the present invention, as shown in FIG. 2-4, the LED illumination unit 100 provides for a visual display comprising an arrangement/combination of LED lights 104 and a faceplate 103 on the unit such as to provide a two and/or three dimensional visual display to the user. LED bulbs 104 can be secured/affixed/attached on a (printed) circuit board 403 to form various shapes 201 202 (e.g., letters, logos, numbers, objects, etc.), where each LED can be programmed and/or controlled to provide an animating display (the circuit board encased in the body/base such as to be not visible to the user). The LED bulbs 104 can be programmed individually or in groups comprising a plurality of LED bulbs. Exemplary embodiments of the present invention provide for higher visibility, versatility, recognition, wider range of color, and brightness or dimness of illumination. For example, as shown in FIG. 3, the LED illumination unit, according to exemplary embodiments of the present invention provides for sequencing LEDs, chasing LEDs, flashing LEDs, animation, and multiple color changes, all within a single LED bulb or a group of one or more LED bulbs.

Another exemplary embodiment of the present invention provides for the LED illumination unit having a graphical display including at least one changeable faceplate displaying graphical logos or objects. According to various embodiments of the present invention, the faceplates can be backlit, front-lit, or any combination of the components, as mentioned above. Further, the faceplate can be partially or fully translucent panel. For example, in a front-lit arrangement, LED bulbs can be arranged on the circuit board towards the faceplate such that LED bulbs are visible directly through the faceplate (e.g., either by holes in the faceplate equal to the size of the LED bulbs or by a transparent cover over the LED bulb). In a similar example, the LED bulbs can be fixed on the circuit board and protrude through holes in the faceplate, thus allowing the user to directly see the LED bulb without the faceplate covering the LED bulb. In such example, the protruding LEDs can be arranged and/or grouped on the circuit board to form the shape of an object (such as a baseball, basketball, etc.).

According to an exemplary embodiment of the present invention, in a back-lit arrangement of LEDs, the LED bulbs can be arranged on the circuit board such that the LED bulbs are not directly visible through the faceplate, rather the faceplate is translucent to allow light emitted from the LED bulbs to illuminate the design on the faceplate. Exemplary embodiments of the present invention comprise UL approved potentiometers on the body of the LED illumination unit to control the speed and brightness of the various LED bulbs.

As shown in FIGS. 1 and 2, an exemplary embodiment of the present invention provides for the LED illumination unit with LED bulbs to form a visual boarder around the perimeter near the outside edge of the faceplate. The LED boarder comprises a plurality of LED bulbs (affixed to a circuit board inside the body of the LED illumination unit) visible through the faceplate (via either opaque or transparent portions of the faceplate) such that the illumination of the LED bulbs is coordinated to present a unified visual display to a user. For example, an LED illumination unit setting provides for the LED bulbs to be constantly illuminated (at varying brightnesses) to provide a visual display of a constant boarder, or the setting of the LED illumination unit can be selected to display flashing LED bulbs such by turning the LED bulbs off/on as indicated. The LED bulbs can be controlled by a POD (explained below), junior controller (explained below) and/or a master controller (explained below) to sequence the lighting/dimming of the LED bulbs such as to have a chasing sequence pattern display (to a viewer). According to another example, the LED boarder can be controlled (as described above) to repetitively flash the LED bulbs (ie., repetitive flash on/of, or strobe). According to another example, the LED boarder can be controlled (as described above) to dim/brighten the LED bulbs (eg., to have a fade in/out visual display). According to another example, the LED boarder can be controlled (as described above) to any pattern or display programmed or customized by the user and/or factory during manufacture.

According to an exemplary embodiment of the present invention, enhanced display features by the LED illumination unit can be provided by a junior controller (explained below) that sends signals to the LED bulbs (via PODs) on the circuit board(s). The enhanced display features provide more animating displays of the LED illumination unit.

According to an exemplary embodiment of the present invention, additional enhanced custom display features by the LED illumination unit can be provided by attachable PODs (explained below) that attach to the body from the outside of the LED illumination unit. The attachable PODs send signals to the LED bulbs on the circuit board(s). The attachable PODS provide the benefit of additional enhanced display features provide more control and animating displays of the LED illumination unit.

According to an exemplary embodiment of the present invention, individually LED bulbs are arranged in a various configurations that such that the LED bulbs are controlled by the power controlled by the master controller via the PODS.

Internal Controls—Controllers

FIGS. 4-7 show internal components of the LED illumination unit according to an exemplary embodiment of the present invention (without the faceplate). For example, the LED illumination unit comprises one or more (printed) circuit boards 403 (each having one or more LEDs) comprising at least one microcontroller 404 ("POD") connected to a master controller 401 (also referred to herein as a master control unit). Exemplary embodiments of the present invention also provide for a junior controller 405 (also referred to herein as a junior control unit) that sends control commands 411 to the PODs 404 for controlling the LED bulbs 104 in the one or more circuit boards 403.

According to an exemplary embodiment of the present invention, the master controller 401 generates and transmits control signals 407 to the one or more PODs 404 for controlling LED bulbs 104 attached 413 to the PODS 404 for creating a coordinated visual display on the LED illumination unit (as shown in FIG. 2 202 201, and FIG. 3—chasing sequence). Each POD 404 controls a group of at least one LED bulb 104 for providing a programmed display and receives/transmits control commands from/to the master controller. The master controller 407 sends/receives control commands 407 to/from each POD 404 for independently and simultaneously controlling the display of the group of at least one LED bulbs 104 (via respective PODs for controlling the LED bulbs to execute the desired control command). For example, the master controller can send commands to a first POD to control a group of flashing LEDs, while sending commands to a second POD to control a group of constantly lit LEDs. Each POD controls a plurality of LED bulbs that are independent of another POD controlling a plurality of other LED bulbs on the circuit board, providing for simultaneous display of LED bulbs attached to different PODs. According to an exemplary embodiment of the present invention, the master controller is connected to the junior controller by a hard wire such as to send and receive command signals to and from the junior controller, for controlling LED bulbs affixed on the circuit board.

An exemplary embodiment of the present invention provides for a master control unit attached to or comprised in the LED illumination unit of the programmable LED illumination system and apparatus. The master controller can be securely attached to the base or the body of the LED illumination unit. The master control unit is connected to the PODS via one or more wire or wireless connections 407 for transmitting control signals. According to an exemplary embodiment of the present invention, the master controller receives a user control signal from the user's remote controller or other source (such as a personal computer, smartphone, user keyboard input, user buttons on the LED illumination unit, etc. . . . ), and generates a POD control signal transmitted to at least one POD for controlling the LEDs coupled to each POD. Each POD generates an LED control signal to each LED bulb attached in the POD to control each individual LED bulb. The LED control signals to the PODs may be individual and independent of LED control signals to other PODS. The LED control signals to the PODS may also be duplicative such that two different PODS are doing the same/similar thing (e.g. two independent PODs may receive a flashing signal to a group of LED bulbs). For example, the master controller generates and transmits a first LED control signal to a first POD to have a chasing sequence of border lights, a second LED control signal to a second POD to flash a basketball looking object, and a third LED control signal to a third POD to have a constantly bight display of a sports team's name, and a fourth LED control signal to a fourth POD to have a dimming/brightening effect of another display object/letter/word, etc. A viewer of the LED illumination unit will see a simultaneous display of all these animation displays, thus providing an enjoyable viewer experience, over the traditional art.

An exemplary embodiment of the present invention provides for the master control unit to generate control signals to control displaying a handwritten looking "DODGERS" along with a flying streaking baseball, while displaying a board near the edges of the faceplate (as shown in FIG. 2). For example, the master controller can receive a user selected control signal from the remote controller, and generate one or more of the POD control signals to the relevant POD for displaying according to the user control signal. A user control signal may not necessarily require generating a POD control signal for every POD, but only the PODs that are necessary to execute the user control signal. When a POD receives the POD control signal, the POD in turn generates one or more LED control signals to control each LED bulb attached to the POD (as needed). So, as shown in FIG. 2, upon the master controller receiving the user control signal for displaying handwritten looking "DODGERS", the master controller generates a POD control signal to one or more respective PODs that control the respective LED bulbs for displaying the handwritten looking "DODGERS" letters. The respective POD(s) will generate a signal to start illuminating (in one or more colors) LED bulbs from one end of the display letters and continue to illuminate one LED at a time, thus literally creating the visual effect of handwriting the word "DODGERS" and/or a logo (as shown in FIG. 2). According to an exemplary embodiment, another POD controls LED bulbs that form a streaking ball simultaneous to the handwriting of DODGERS, for having the visual effect of a baseball streaking through the air through the word DODGERS. And further, according to an exemplary embodiment, the master controller transmits a POD control signal to another POD to control LED bulbs that form a board near the perimeter of the faceplate of the LED illumination unit.

According to an exemplary embodiment of the present invention, the master controller comprises a central processing unit ("CPU")(or any processor means) that is programmed at the time of manufacture to receive control signals, process the control signals, and selectively dispatch the control signals to the respective PODS. If the CPU does not receive any control signal after being powered on, the CPU transmits default control signals to the respective PODs (e.g, such as to maintain the LED bulbs in a constant 'on' illumination state), and the default control signal remains active until a further control signal is received from either the remote controller, user input (via attached computer, keyboard, knobs, and/or buttons located on the LED illumination unit).

According to an exemplary embodiment of the present invention, the master controller of an LED illumination unit intelligently controls the individual LED bulbs (with or without the PODS). For example, the master controller obtains electrical energy from the power supply unit (described below) to power the individual LED bulbs, generates the required regulated voltages to power the LED bulbs on the circuit board, the PODs, a junior controller (if included) and the master controller, demodulating and decode user control signals received from the user controls (eg., remote controller, described below), generate and transmit POD control signals to drive groups of LEDs.

According to an exemplary embodiment of the present invention, a circuit board comprising LED bulbs and/or PODS is connected or fastened to the base or body of the LED illumination unit, and can be secured by brackets to the base or body, respectively. The circuits of the circuit boards are connected by wires to the low voltage terminals of the power supply and/or connected by wires to the low voltage terminals of the master controller and/or junior controller. The circuits of the PODs on the circuit board may be interconnected by electrical conductors or wires, or by any other connector means to carry a control or electrical signal.

As shown in FIG. 4, an exemplary embodiment of the present invention provides for a junior controller 405 comprised in the LED illumination unit 100 of the LED illumination method, system and apparatus, for providing enhanced functions to the LED bulbs 104. The junior controller 405 connects 411 to the one or more PODs 404 in circuit board 403, thereby providing a LED control signal for controlling the LED bulbs. The junior controller provides the benefit of additional functionality to supplement the logic and LED functionality of the master controller. For example, the junior controller can provide for enhanced functionalities such as higher brightening capabilities, synchronized flashing of LED bulbs, etc. . . . (such as functionality that is not in the master controller). According to an exemplary embodiment of the present invention, the junior controller receives power signals from the master controller. The junior controller can receive electric power directly 406 from the power supply unit 402 or via the master controller 401.

As shown in FIG. 10, an exemplary embodiment of the present invention provides for one or more attachable PODs 1001 that connect to the LED illumination unit through an interface in the body 101, and provide the benefit of additional enhanced functionality of the LED bulbs on the circuit board. The attachable POD connects to the body 101 at a interface/socket 1002 capable of receiving the attachable POD, and the socket 1002 attaches to the circuit board with wires capable of transmitting signal from the PODs 1001 to the LED bulbs 104. Once attached to the socket 1002, the additional enhanced functionality provided by the attachable POD 1001 is in addition to the functionality provided for by the master controller and when included, the junior controller. For example, the attachable POD may be inserted, by a user, into a socket to interface with the LED illumination unit and connects directly to the circuit board (via a connection in the circuit board to receive the attachable POD(s)). The external POD may provide functionalities of the LED bulbs such as patterned light sequences or flashes (for example, to synchronize with music), or may provide for other alternate illumination of the LED bulbs.

According to an exemplary embodiment of the present invention, the master controller (and/or junior controller) receives electric power charge from the power supply. The controller then divides the received power into power signals in accordance with the user selected functionality (from the one ore more user controls (shown below)), then transmits the power signals to one or more PODs on the circuit board for performing the user selected functions. In turn, the PODs send electric power signals to the LED bulbs attached to the respective PODs to perform the user selected function.

According to exemplary embodiments of the present invention, the POD control signal and the LED control signals generated and transmitted by the master controller and/or the junior controller comprise power signals.

User Controls

An exemplary embodiment of the present invention provides for changing, programming and/or customizing the display of the LED illumination system based on input signals from a user via keyboard, computer keyboard, keypad/buttons on the LED illumination unit, and/or from a wired/wireless remote controller unit 408.

According to an exemplary embodiment of the present invention, the LED illumination unit comprises one or more input buttons 1003 and/or one or more turning knobs 1003 on outside component of the LED illumination unit. User input buttons can be placed the body and/or the base such that a user input the desired control instructions for controlling the display of the LED illumination unit. For example, a user can enter a control on one or more buttons and or the turning knobs on the body of the LED illumination unit to control the LED bulbs to perform various functions (e.g., flashing, dimming/brightening, chasing sequence, etc.).

Figure 6:
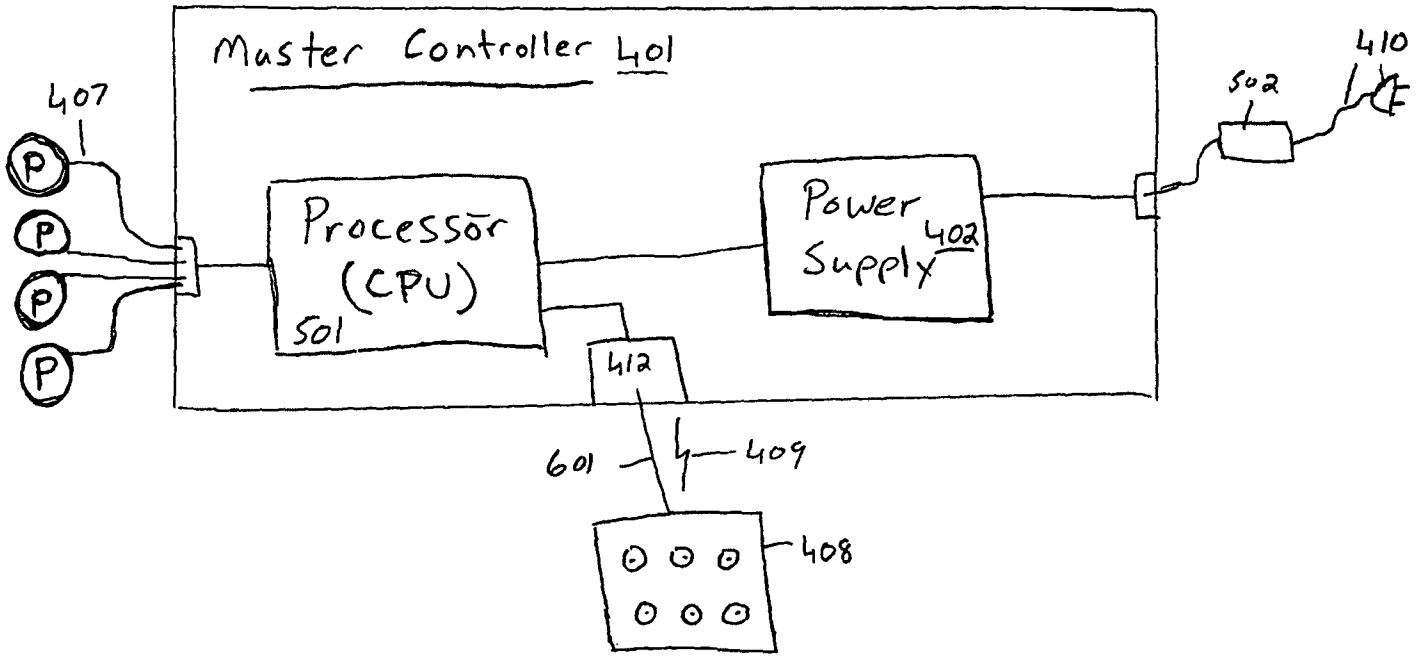
FIG. 6 is a block diagram of the architecture of the master controller of the LED illumination unit, according to an exemplary embodiment of the present invention.

According to an exemplary embodiment of the present invention, a remote controller 408 provides a user control signal to the LED illumination unit in the LED illumination system for controlling the display of the unit. For example, the user control signal comprises a signal to control the LED bulbs to perform various functions (eg., flashing, dimming/brightening, chasing sequence, etc. . . . ). According to an exemplary embodiment, as shown in FIGS. 6 and 8, the remote controller 408 can be wired to the LED illumination unit 601, or be wireless from the LED illumination unit via a radio frequency ("RF") signal 409.

Figure 8:
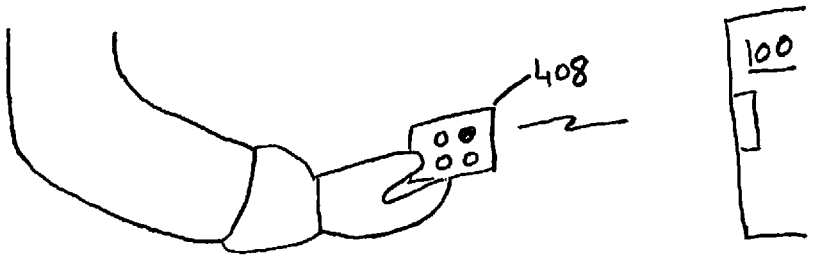
FIG. 8 is a diagram that illustrates the remote controller for selecting functions to be executed by the LED illumination unit, according to an exemplary embodiment of the present invention.

According to an exemplary embodiment of the present invention, as shown in FIG. 8, a user can change the visual display of the LED bulbs comprised in the LED illumination unit by selecting and inputting a command signal from the remote controller 408 which generates and transmits a user control signal 409 to the RF receiver attached to the master controller 412 in the LED illumination unit. The master controller 401 then generates and transmits POD control signal(s) to the relevant PODS 404 via control lines 407. In turn, the relevant PODS 404 generate a LED control signal to control the necessary LED bulbs 104 attached to each said POD 404, resulting in the desired visual display by the LED illumination unit (as shown in FIG. 2, 3).

According to an exemplary embodiment of the present invention, a remote controller unit 408 comprises a remote controller body having a plurality of buttons for user to selectively input a desired display of the LED bulbs comprised in the LED illumination unit. Upon selecting a button by a user, the remote controller generates a user control signal (a RF signal) that is transmitted to a receiver to the master control unit. The plurality of buttons and/or on the remote controller body are programmed into the remote controller at the time of manufacture and/or can be changed by post-manufacture by re-programming the remote controller. For example, the remote controller can be pre-programmed at the time of manufacture to contain a number of functions (eg., flashing, dimming, etc.).

Alternatively, according to an exemplary embodiment of the present invention, a user control signal can be generated by a user using a smartphone (eg., an iPhone, Blackberry, etc), a computer (desktop, laptop), a tablet computer (such as an ipad) via a Bluetooth or other wireless signal.

A nightlight LED illumination unit, according to an exemplary embodiment of the present invention comprises one or more turning knobs on the outside of the LED illumination unit, where the knobs are used by the user to adjust the dimming/brightening of the LED bulbs attached to the circuit board (via a POD) inside the nightlight LED illumination unit.

Power Control

Figure 5:
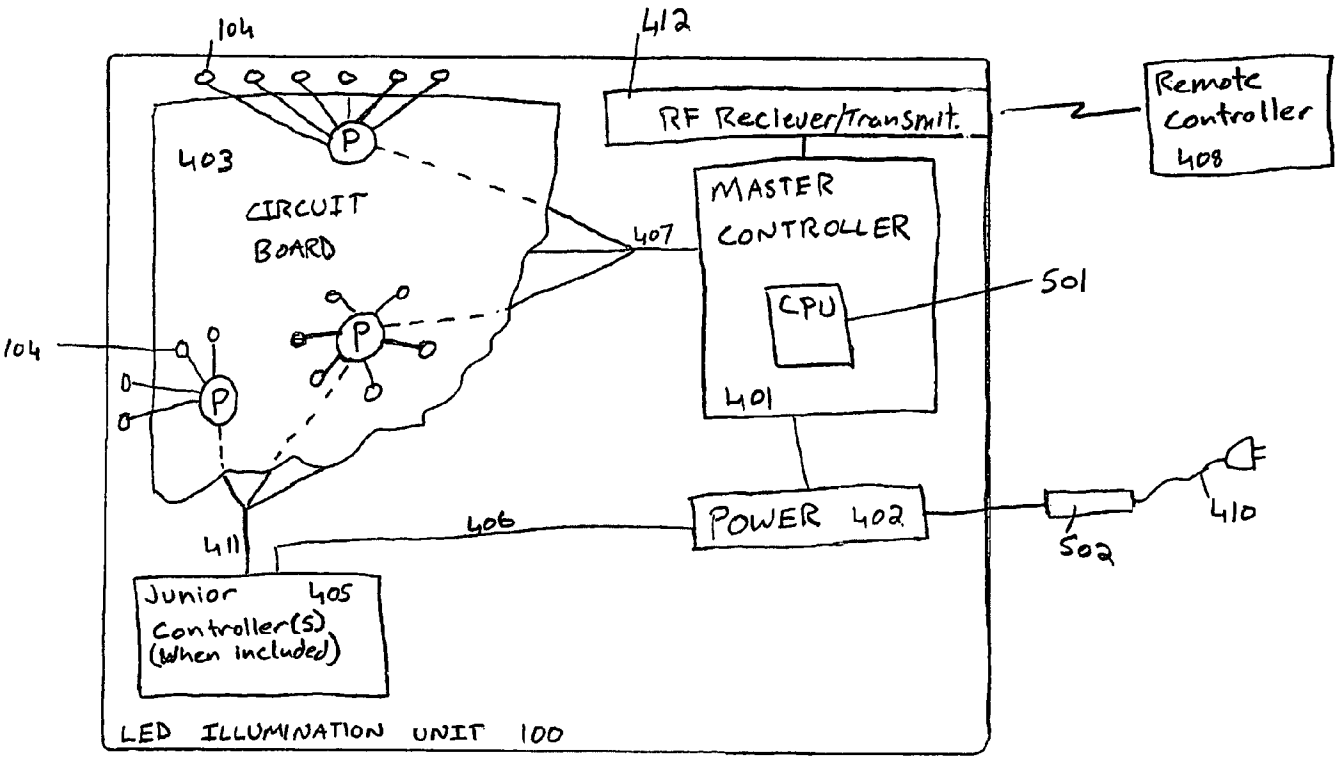
FIG. 5 is a block diagram of the overall architecture of the LED illumination unit, according to an exemplary embodiment of the present invention.

According to an exemplary embodiment of the present invention, as shown in FIGS. 4-7 and 9, the LED illumination unit is powered by a low voltage UL approved direct current (DC) power supply unit 402 inside the body 101. The power supply unit 402 can plug into a 110 VAC electric outlet 410 using a transformer 502, solar panel, electric grid and/or battery. The power supply unit 402 can be encased inside the master controller 401 in the LED illumination unit as shown in FIG. 6, or can be placed outside the master controller and attached to the base of the LED illumination unit as shown in FIGS. 4, 5. Alternatively, the transformer can be external and attached to the body and connected by wires to the electric components inside the body via the power supply unit in the master controller. The power supply unit 402 provides electric power to the master controller 401 and/or the junior controller(s) 405, via an internal power line 406.

According to an exemplary embodiment, the electric power supply unit 402 receives power (from one or more of the sources listed above) and distributes the received power to the master controller 401, PODS 404, junior controller 405 (when included) and plurality of LED bulbs 104. A distributor can provide electric power to the LED bulbs disposed on the circuit board. Electric power can be provided selectively to the PODS to provide for a controlled pattern forming a user controlled illuminated visual display, by connecting and disconnecting power to the various PODS and/or LED bulbs in the LED illumination unit. For example, to create the visual effect desired by a user, some LED bulbs can be illuminated by providing them power in a manner designated by the master controller via the PODS, whereas other LED bulbs may be not illuminated by not providing those LED bulbs power in a manner designated by the master controller and PODS.

According to an exemplary embodiment, the power supply unit includes casing or housing comprising electrical storage battery or another other forms of retaining electrical power. For example, a solar panel may be attached to attached to the power supply unit to recharge the battery via a chord and connector plug for connecting solar panel to the housing and its internal battery. Alternatively, the LED illumination unit may be powered from a conventional 12-V power supply (e.g., a motor vehicle battery).

According to an exemplary embodiment of the present invention, the power received by the power supply unit is transmitted to the master controller and then to the plurality of individually controlled LED bulbs, the PODS, the junior controller and the master controller.

According to an exemplary embodiment of the present invention, to provide LED control to all of the individually controlled LED bulbs, the master controller modulates data onto an electric current driven to each LED bulb.

Other Exemplary Embodiments

An exemplary embodiment of the present invention provides for an LED illumination unit as a nightlight. For example, a nightlight embodiment of the LED illumination unit comprises a body including backlit or front-lit faceplate, a base (optional), LED bulbs affixed to a circuit board inside the body, a controller unit (such as a master controller and/or PODs), user control means (buttons, knobs) on the nightlight, and power interface attached to the body (such as a plug into the wall). According to an embodiment, the nightlight can be plugged into the electrical socket of a wall/floor of a building directly such that the body and base are attached on top of the wall plug. Alternatively, according to an embodiment, the nightlight can be placed on a surface (such as a table) using the base of the unit and plugged into the wall outlet via an extension chord. An embodiment of the nightlight provides for a backlit faceplate where the faceplate is made of a translucent material displaying a animated design or logo (such as a sports team, singer, company logs, etc), and upon illumination of the LED bulb(s) in the body, the faceplate illuminates to provide an animated display to the user. An embodiment of the nightlight provides for a front-lit faceplate where the LED bulbs, affixed on the circuit board inside the body, protrude out from holes in the faceplate such that the LED bulb(s) is directly visible through the faceplate. The arrangement of the bulbs can be arranged to illuminate through the faceplate such as to provide an animating display to a user. An embodiment of the nightlight provides for user control means (buttons, knobs) on the body so that a user can adjust the settings to customize the illumination, animation of the LED bulbs. For example, a user can turn a knob on the back of the LED illumination unit to adjust dimming/brightening of the LED bulbs An exemplary embodiment of the present invention provides for a LED illumination unit as a tabletop display (such as a nightstand). For example, a tabletop embodiment of the LED illumination unit comprises a body including backlit or frontlit faceplate, a base, LED bulbs affixed to a circuit board inside the body, a controller unit (such as a master controller and/or PODs), a user control means (buttons, knobs) on the nightlight, and power interface attached to the body (such as a plug into the wall or a battery or any other power source). An embodiment of the tabletop provides for a backlit faceplate where the faceplate is made of a translucent material displaying a animated design or logo (such as a sports team, singer, company logs, etc), and upon illumination of the LED bulb(s) in the body, the faceplate illuminates to provide an animated display to the user. An embodiment of the tabletop provides for a front-lit faceplate where the LED bulbs, affixed on the circuit board inside the body, protrude out from holes in the faceplate such that the LED bulb(s) is directly visible through the faceplate. The arrangement of the bulbs can be arranged to illuminate through the faceplate such as to provide an animating display to a user. An embodiment of the nightlight provides for user control means (buttons, knobs) on the body so that a user can adjust the settings to customize the illumination, animation of the LED bulbs. For example, a user can turn a knob on the back of the LED illumination unit to adjust dimming/brightening of the LED bulbs. Additionally, the tabletop embodiment of the LED illumination unit can also receive control signals from a user via remote controller (as described above) to customize the display.

Other exemplary embodiments of the present invention provide for the following sizes/configurations/implementations of the LED illumination system, method and/or apparatus: (1) Self standing Table or Bar Display Unit; (2) Wall Mounted Style Unit; (3) Hanging Style Unit; (4) Vertical Style Unit; (5) Smaller Nightlight Unit (comprising Motion Sensors to Embody On/Off Functions, Includes another motion sensor which triggers a clock display, ABS Fire Retardant Molds/Body, LED Illuminated and Dimmable Graphic Display); (6) Six foot Unit/Computer Controlled (comprising Audio Output, Changeable Graphic Logos, Additional Code Changes through the Manual Transmitter/Controller); (7) Jumbo Version Unit—Large Scale (e.g., "Jumbotron", Spinning, and Fully LED Animated Graphic Display, a working Sports/Entertainment Television. Various sizes: Twenty five feet tall, and Forty five feet long. Also includes an ability to launch fireworks and Emit Lasers from the top of the sign).

The above-described exemplary embodiments of an apparatus, system and method in computer-readable media include transitory and/or non-transitory program instructions to implement various operations embodied by a computer. The media may also include, alone or in combination with the program instructions, data files, data structures, and the like. The media and program instructions may be those specially designed and constructed for the purposes of the present invention, or they may be of the kind well-known and available to those having skill in the computer software arts. Examples of computer-readable media include magnetic media such as hard disks, floppy disks, and magnetic tape; optical media such as CD ROM disks and DVD; magneto-optical media such as optical disks; and hardware devices that are specially configured to store and perform program instructions, such as read-only memory (ROM), random access memory (RAM), flash memory, and the like. The media may also be a transmission medium such as optical or metallic lines, wave guides, and so on, including a carrier wave transmitting signals specifying the program instructions, data structures, and so on. Examples of program instructions include both machine code, such as produced by a compiler, and files containing higher level code that may be executed by the computer using an interpreter. The described hardware devices may be configured to act as one or more software modules in order to perform the operations of the above-described embodiments of the present invention.

Although exemplary embodiments of the present invention have been disclosed for illustrative purposes, those skilled in the art will appreciate that various modifications, additions, and substitutions are possible, without departing from the scope of the present invention. Therefore, the present invention is not limited to the above-described embodiments, but is defined by the following claims, along with their full scope of equivalents.

What is claimed is:

1. A dynamically programmable LED illumination device for displaying animated LED graphics based on at least one user control command, the device comprising:

an LED display body comprising at least one faceplate on an outside portion of the body, at least one printed circuit board, a command receiver, a power supplier, and a master controller;

the faceplate comprising said animated LED graphics to display light from at least one LED bulb affixed to said at least one printed circuit board;

the at least one printed circuit board comprises at least one microcontroller and said at least one LED bulb;

a command receiver that receives said at least one user control command from a user input;

a power supplier that receives electric power and transmits the electric power to said master controller and said at least one microcontroller;

said master controller demodulates and decodes said user control command into at least one LED command signal, and selectively transmits said at least one LED command signal to said at least one LED bulb, via said at least one microcontroller, upon determining which user control command is selected for displaying said animated LED graphics based on the user control command; and the at least one microcontroller receives said LED command signal from the master controller and transmits said least one LED command signal to the at least one LED bulb attached to said microcontroller, wherein the at least one LED bulb illuminates according to the LED command signal received from said master controller via said microcontroller, wherein the LED command signal comprises an electric signal, and wherein said animated LED graphics are displayed by selectively illuminating the at least one LED bulb according to said at least one LED command signal.

2. The device of claim 1, wherein the user input comprises at least one of a remote controller, one or more buttons on the device, one or more knobs on the device, and an interface on the device that user can input said user control command signal.

3. A dynamically programmable LED illumination system for displaying animating LED graphics based on at least one user control command, the system comprising:

an LED display body unit comprising at least one faceplate unit on an outside portion of the body unit, at least one printed circuit board unit, a command receiver unit, a power supplier unit, and a master controller unit;

the faceplace unit comprising said animated LED graphics to display light from at least one LED bulb affixed the at least one printed circuit board unit;

the at least one printed circuit board unit comprising at least one microcontroller and said at least one LED bulb;

the command receiver unit receives at least one user control command from a user input; and the power supply unit receives electric power and transmits the electric power to said master controller unit and said at least one microcontroller unit;

the master controller unit demodulates and decodes said user control command into at least one LED command signal, and selectively transmits said at least one LED command signal to said at least one LED bulb, via said microcontroller, upon determining which user control command is selected for displaying animated LED graphics based on the user control command;

the microcontroller unit receives said LED command signal from the master controller unit and transmits the at least one LED command signal to the at least one LED bulb unit attached to said microcontroller, wherein said LED bulb unit illuminates according to the LED command signal received from said master controller via said microcontroller, wherein the LED command signal comprises an electric signal, and wherein animated LED graphics are displayed by selectively illuminating the at least one LED bulb according to said at least one LED command signal.

4. The system of claim 3, wherein the user input unit comprises at least one of a remote controller, one or more buttons on the device, one or more knobs on the device, and an interface on the device that user can input said user control command signal.

5. A method for displaying animating LED graphics based on at least one user control command signal on a dynamically programmable LED illumination device comprising an LED display body wherein the LED display body comprises at least one faceplate on an outside portion of the body, at least one printed circuit board, a command receiver, a power supplier, and a master controller, the method comprising steps for:

receiving, at said master controller, said user control command signal from a user input for selecting and displaying one or more of the animating LED illumination on said faceplate;

receiving, at said power supplier, electric power and transmitting the electric power to said master controller and said at least one microcontroller;

determining, by the master controller, at least one LED bulb to illuminate based on the user control command signal, by demodulating and decoding said user control command signal into at least one LED command signal;

selectively transmitting, by the master controller, the at least one LED command signal to the at least one LED bulb, via the at least one microcontroller; and transmitting, by the microcontroller, the at least one LED command signal from the master controller to the at least one the LED bulb connected to the microcontroller, to illuminate the at least one LED bulb attached to said microcontroller, wherein the microcontroller executes said command signal transmitted to the LED bulbs, wherein said faceplate comprises LED graphics to display light from the at least one LED bulb affixed at the at least one printed circuit board, wherein the at least one LED bulb illuminates according to the LED command signal received from said master controller via said microcontroller, wherein said LED command signal comprises an electric signal, and wherein said animated LED graphics are displayed by selectively illuminating the at least one LED bulb according to said at least one LED command signal.

6. The method of claim 5, wherein receiving the user command signal comprises receiving by at least one of a remote controller, one or more buttons on the device, one or more knobs on the device, and an interface on the device that user can input said user control command signal.

* * * * *